US011530904B2

(12) United States Patent
Albayrak

(10) Patent No.: US 11,530,904 B2
(45) Date of Patent: Dec. 20, 2022

(54) ELECTROSHOCK WEAPON

(71) Applicant: ALBAYRAKLAR SAVUNMA TEKNOLOJiLERi SANAYi VE TiCARET ANONiM ŞIRKETi, Istanbul (TR)

(72) Inventor: Adnan Albayrak, Istanbul (TR)

( * ) Notice: Subject to any disclaimer, the term of this patent is extended or adjusted under 35 U.S.C. 154(b) by 186 days.

(21) Appl. No.: 17/251,992

(22) PCT Filed: Jul. 18, 2019

(86) PCT No.: PCT/TR2019/050593
§ 371 (c)(1),
(2) Date: Dec. 14, 2020

(87) PCT Pub. No.: WO2020/096545
PCT Pub. Date: May 14, 2020

(65) Prior Publication Data

US 2021/0262770 A1 Aug. 26, 2021

(30) Foreign Application Priority Data

Jul. 20, 2018 (TR) ..... 2018/10431

(51) Int. Cl.
*F41H 13/00* (2006.01)

(52) U.S. Cl.
CPC ..... *F41H 13/0031* (2013.01)

(58) Field of Classification Search
CPC ..... F41H 13/0031; F41H 13/00; F41B 7/003
See application file for complete search history.

(56) References Cited

U.S. PATENT DOCUMENTS

| | | | | |
|---|---|---|---|---|
| 8,356,438 | B2 * | 1/2013 | Brundula | F41A 17/063 42/84 |
| 9,354,026 | B2 * | 5/2016 | Hanchett | F41H 13/0025 |
| 10,168,127 | B1 * | 1/2019 | Salisbury | F41H 13/0025 |
| 10,598,467 | B1 * | 3/2020 | McDermit | F41A 9/70 |
| 2006/0207466 | A1 * | 9/2006 | McNulty | F41H 13/0025 361/232 |
| 2015/0153144 | A1 | 6/2015 | Cheatham, III et al. | |
| 2016/0040965 | A1 | 2/2016 | Chang | |

FOREIGN PATENT DOCUMENTS

| | | |
|---|---|---|
| CN | 107883811 A | 4/2018 |
| KR | 101872709 B1 | 7/2018 |

OTHER PUBLICATIONS

International Search Report and Written Opinion for Application No. PCT/TR2019/050593 dated Jun. 10, 2020.

* cited by examiner

*Primary Examiner* — Joshua T Semick
(74) *Attorney, Agent, or Firm* — Crose Law LLC; Bradley D. Crose

(57) ABSTRACT

A novel electroshock device is provided. The novel electroshock device includes a weapon body, a magazine, and at least one electroshock projectile which is used by being positioned into a magazine and ensures that a target is subjected to shock by being fired to the target, and which has no physical connection with the magazine or with a weapon body after being fired to the target.

26 Claims, 4 Drawing Sheets

ELECTROSHOCK WEAPON

CROSS-REFERENCE TO RELATED APPLICATIONS

Figure 1:
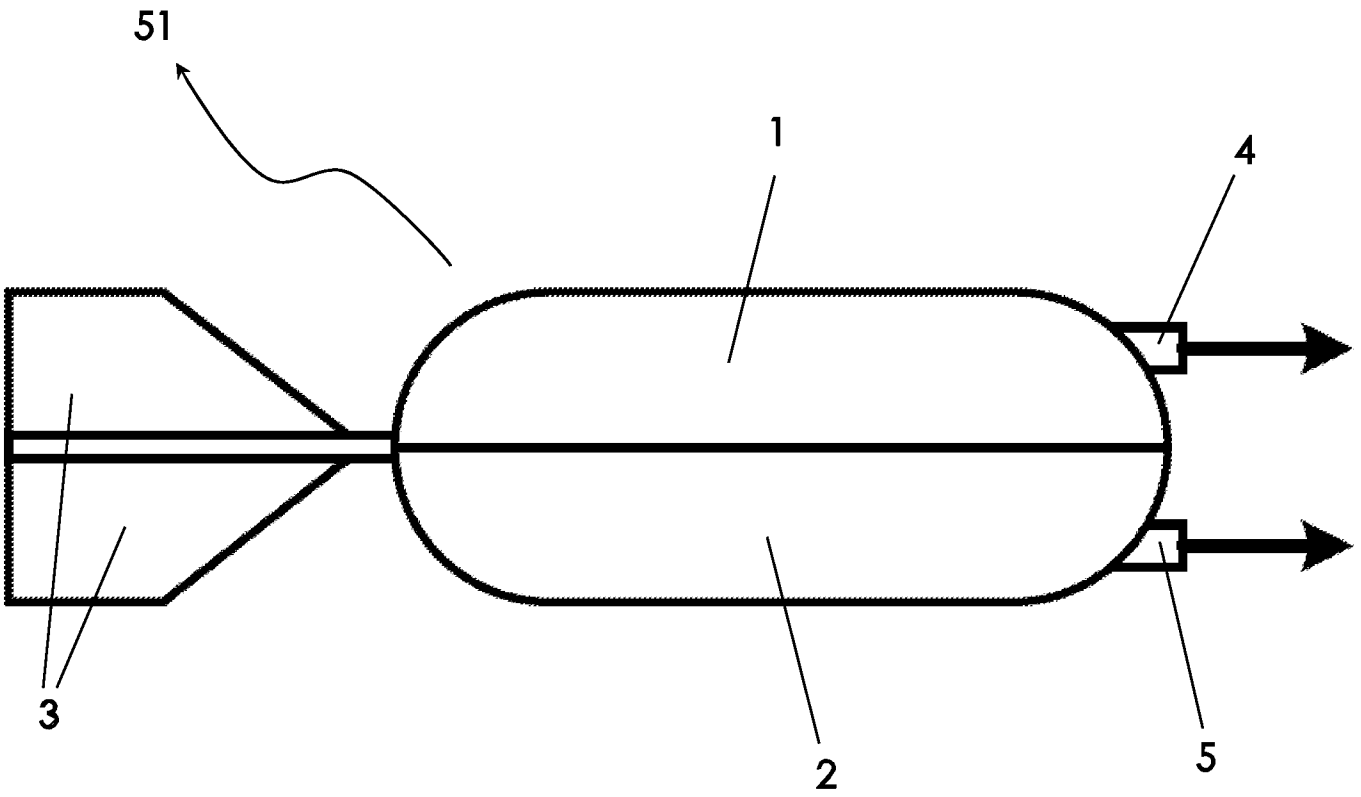

The present application is a national phase entry of PCT/TR2019/050593, filed on Jul. 18, 2019, which claims the benefit of priority of Turkish Patent Application No. 2018/10431, filed Jul. 20, 2018, the entire contents of which are hereby incorporated by reference in their entirety for all purposes.

TECHNICAL FIELD

This invention relates to a new electroshock weapon which can be used both in contacted and contactless manner, by which a projectile is fired towards the target by a mechanical ejection system and the ejection process is performed silently.

BACKGROUND

The movements performed by human body are controlled via electrical signals transmitted to the muscles by the brain. Accordingly, when electricity above a certain amount is applied to human body, motion signal is sent to muscles continuously and the muscles are kept in contracture and the body becomes cannot function for a while. Said nonfunctional period not only depends on sensitivity of muscle system of the person but also on amount and duration of electrical current applied.

Electroshock devices which operate to utilize said nonfunctional state of body have been developed. The main operating principle of electroshock devices is to take down aimed living by applying a certain amount and a certain period of time electricity. Electroshock devices are particularly ideal apparatus in order to overcome the situations such as for security forces to catch dangerous persons, defenseless persons to protect themselves from attackers and wild animals to be temporarily taken down.

There are many different types of electroshock devices in the present art. Said electroshock devices are separated into different groups, particularly depending on their use. Said forms of utilization are divided into three categories as contact, wired and wireless.

Contact electroshock devices used in the state of the art are the devices with many models and the ones used most commonly in the sector. These devices are used by direct contact with the target living. Two ends, one positive and other negative located on front section of the device are contacted to the targeted living thereby shocking said living. Contact electroshock devices needed to be used at close range show very effective results. However, these devices are extremely ineffective for targets at long distance. It is a significant disadvantage that they can only be used on targets at distance of contacting. Particularly, if targeted living is dangerously aggressive and/or armed, use contact electroshock devices required to be physically contacted becomes particularly difficult.

Wired electroshock devices which are another electroshock device model used in the present art have generally the form of a handgun. These devices can simultaneously eject two end structures, one positive and other negative, to be ejected to targeted living from a certain distance. The positive and negative ends ejected towards the targeted living also stay in connection with the wired electroshock device via single wires. Hence, the ends ejected to target have a range that can reach to targets at distances not to be farther than lengths of said wires.

Many problems are encountered in the present art regarding the said wired electroshock devices. The main one of these problems is the way that the positive and negative ends are ejected to the target. Conductive arrows carrying high voltage on wired electroshock devices are ejected at the same time to target by firing wired electroshock device. Said two arrow structures, which form the positive and negative ends, are ejected to the target at high speed by a flammable gas explosion. This makes the flammable gas explosion obligatory for the ejection process, thus causing the system to be dangerous for the users. The ends consisting of arrows ejected by the explosion of flammable gas may be deformed over time due to the explosion.

Furthermore, the range that the arrows can be effective varies depending on the degree of the flammable gas explosion. Therefore, a dangerous ejection form is obtained.

Another problem related to the wired electroshock devices is the moving of the positively and negatively charged arrows ejected to the target away from each other until they reach the target. The arrows having a few centimeter distance therebetween are separated from each other for tens of centimeter away until they reach the target depending on several factors such as distance to target, firing angle and wind after being fired. This prevents the device to operate at desired efficacy and leads to miss fire of the aimed target. Else, because of scattering, the target may be hit from undesired vital points (eye, throat, face, chest, etc.) after shooting thereby leading to serious injuries. Hence, it is not always possible that positive and negative charged arrows reach the target as desired while shooting via wired electroshock devices. This is an essential problem frequently encountered in the present art.

Another important problem encountered with the wired electroshock devices used in the state of the art is the presence of the wire structure. The speed of the arrows are reduced, due to the fact that the positive and negative charged arrows sent to the target are constantly connected to the wired electroshock weapon via single cables. This requires said arrows to be fired at higher speeds. Thus, more energy is consumed during the firing of arrows. In addition, high speed crashes may occur when the arrows are ejected at high speeds to targets at close distances, and this may lead to various injuries.

With the wired electroshock devices, electroshock device can be inactivated from time to time due to presence of the wire structure constantly connected to the arrows. The main reason of this situation is that when the positive and negative charged arrows ejected towards the target did not yet reach the target, the wires to which the arrows are connected come into contact with each other. While the basic principle of electroshock devices is to ensure that an electric current is passed on the target by the simultaneous contact of the positive and negative charged ends with the target living, the efficacy of the electroshock device is lost by the contact of the wires of the arrows with each other in the air before being in contact with the target. Because of aid wires, livings around and being not a target may be subjected to electricity current when they accidently contact with the wire structures. Thereby, the presence of said wire structures both negatively affect the effective use of wired electroshock devices and also create problems for the living around and being not a target. This requires a high level of attention during use of wired electroshock devices.

Another problem encountered with wired electroshock devices is that they have only one shock level. While no changes can be made on the shock level wanted be transmitted to the target, all targets are subjected to same amount of shock level although they have different sizes. This issue not only causes high shock level for some targeted livings but also create the problem of inadequate shock level for some targeted livings. Therefore, it is problem in the present art since the wired electroshock devices have one non-adjustable shock level.

Another problem encountered regarding the wired electroshock devices used in the state of the art is that they have a structure not allowing burst firing. In said wired electroshock devices, the wires connected to the arrows are housed in a cartridge structure. When a target is fired, the wires in the cartridge go out of the wired electroshock device. This prevents the second shot with said wired electroshock device. For a second firing, a new cartridge ready for firing must be used and the wired electroshock device must be disconnected with the first fired wires. Therefore, said electroshock devices have a structure not suitable for burst firing.

Another structure used in the present art is wireless electroshock device. There is no wire connection between the arrows ejected towards living and the wireless electroshock device in said wireless structures. Thus, the problems arising due to presence of wire structure in wired electroshock devices are eliminated by the wireless electroshock devices. However, based on properties of the wireless electroshock devices, different problems are encountered in the state of the art.

Electroshock projectiles fired to living targets by wireless electroshock devices have structure having one positive and one negative end thereon. Both the positive end and negative end must be contacted with the target at the same time in order for said electroshock projectiles to be able to shock target. This requires the shooting to be performed meticulously. It may be difficult to hit the target as desired, especially if the positive end and the negative end on the electroshock shocking projectile are positioned irregularly. If both ends do not come into contact with the target, the desired shock cannot be transmitted to the target and the target cannot be taken down.

The electroshock projectile ejected towards the target is fired by gas explosion or gunpowder explosion in the state of the art electroshock devices. This makes it obligatory for the wireless electroshock devices to cooperate with a chemical agent. Since the chemical substances always present a danger, extra measures are taken during the use of wireless electroshock devices. Therefore, the wireless electroshock devices with gas explosion or gunpowder explosion are structures which both present a danger for users and also use of which requires extra attention. Furthermore, the sound arising during ejecting process with gas explosion or gunpowder explosion in said wireless electroshock devices causes a serious noise problem.

Another problem encountered with the present art wireless electroshock devices is that the amount and duration of shock applied to the target living cannot be adjusted. Shock volume and applying duration exerted by electroshock projectiles to be fired to target in said electroshock devices are predetermined. Thus, shock volume and duration cannot be changed after electroshock projectiles are ejected towards the target. This causes application of same shock volume each time for different type of targets and leads to problems of excessive shock for targets for which less shock is sufficient and of inadequate shock for targets for which more shock volume is needed. Therefore, not being able to adjust shock volumes and durations of electroshock projectiles on said wireless electroshock devices may cause serious problems.

SUMMARY

The object of the invention is to provide a novel electroshock device which operates wirelessly and has a structure capable of hitting targets within a certain range.

A further object of the invention is to provide a novel electroshock device capable of safely firing electroshock projectiles without comprising any chemicals therein.

Another object of the invention is to provide a novel electroshock device wherein the electroshock projectiles ejected towards the target living are capable of reaching the target such that it functions without having any scattering problems.

A further object of the invention is to provide a novel electroshock device generating low level of noise during the ejection process.

A further object of the invention is to provide a novel electroshock device wherein shock level and duration to be applied can be adjusted according to target living.

Another object of the invention is to provide a novel electroshock device which can control the ejected electroshock projectiles by wirelessly connecting them without any physical connection.

Another object of the invention is to provide a novel electroshock device which allows the electroshock projectiles ejected towards the target to re-shock said target when required.

A further object of the invention is to provide a novel electroshock device allowing for burst firing.

A further object of the invention is to provide a novel electroshock device which allows consecutive shocks in series to be fired to multiple targets without making any intervention on it.

BRIEF DESCRIPTION OF THE SEVERAL VIEWS OF THE DRAWINGS(S)

FIG. 1. Electroshock Projectile

Figure 2:
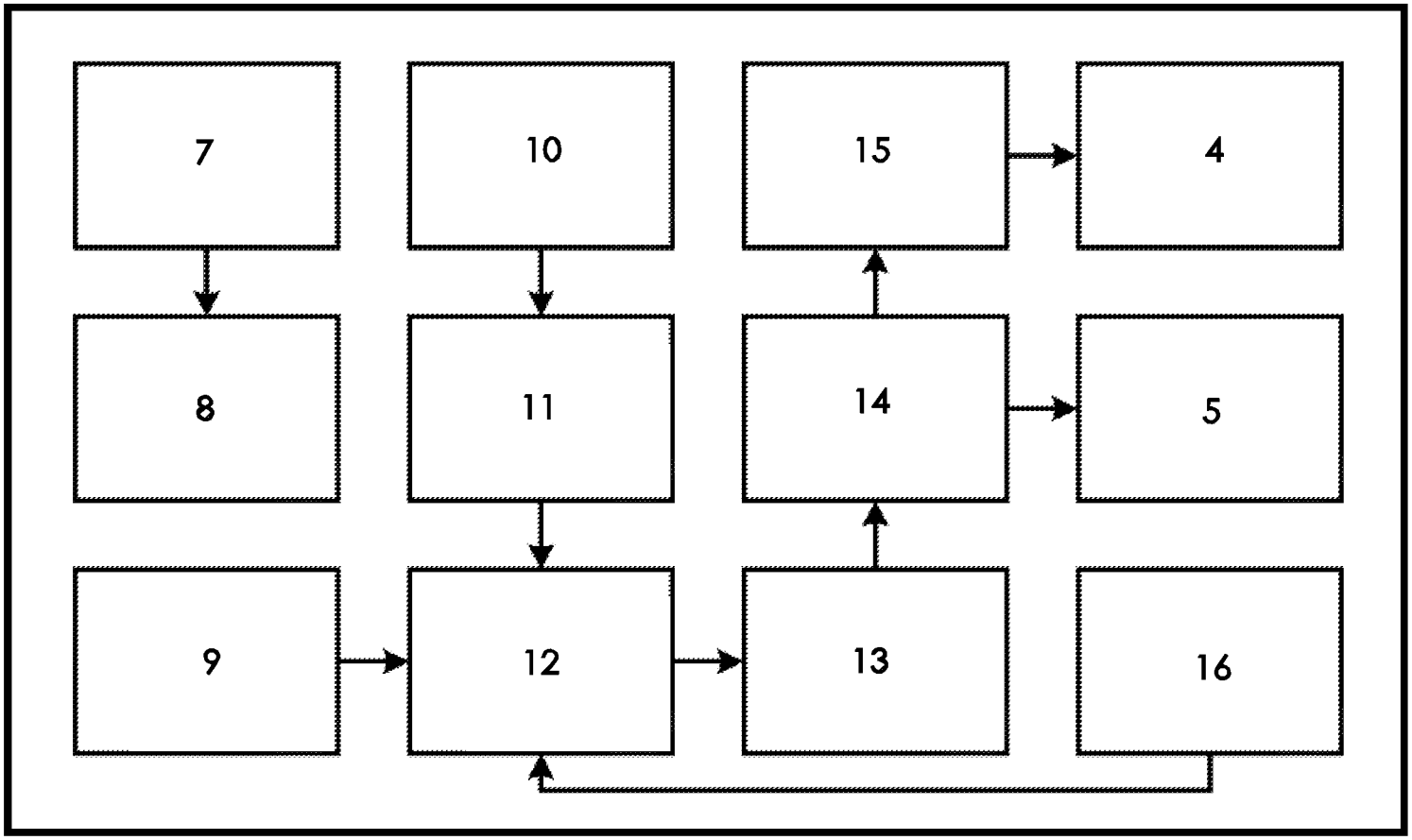

FIG. 2. Electronic Internal Structure of Electroshock Projectile

Figure 3:
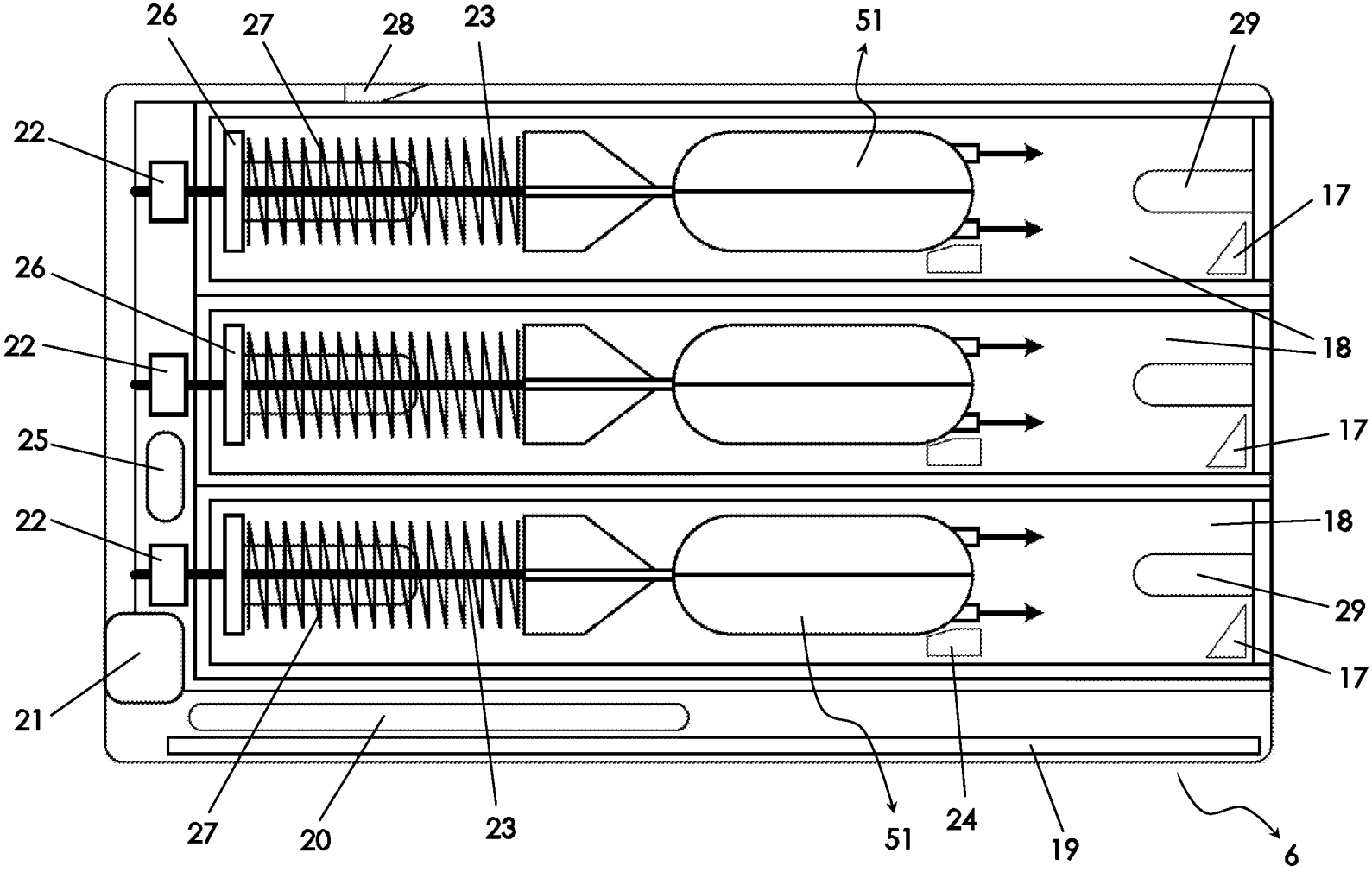

FIG. 3. Magazine Structure

Figure 4:
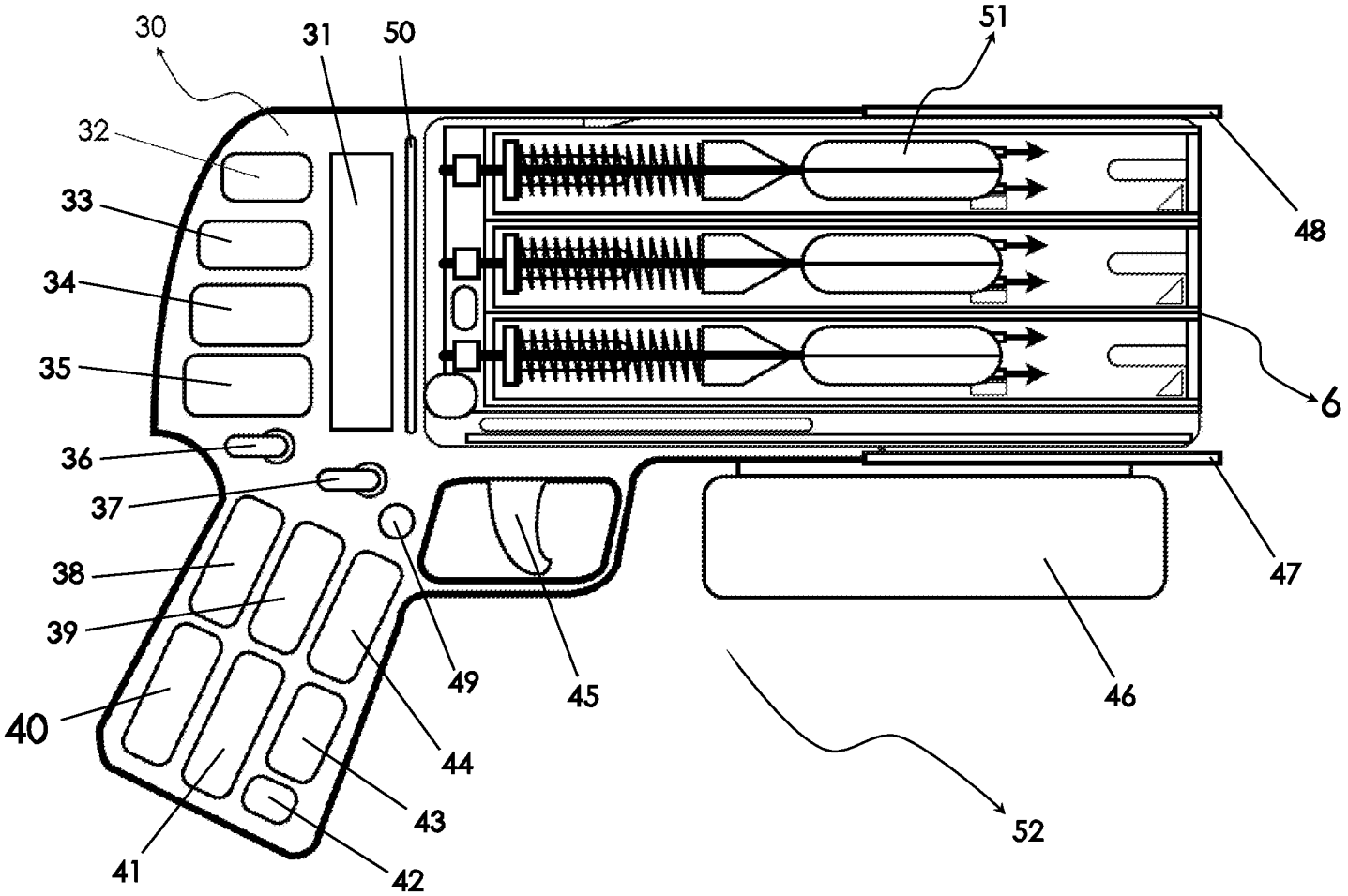

FIG. 4. Electroshock Device

The parts shown in the figures are enumerated individually and names of the parts corresponding to these numbers are as follows:

1. Upper Body
2. Lower Body
3. Wing
4. Positive Needle
5. Negative Needle
6. Magazine
7. Battery
8. Power Unit
9. Micro Switch
10. Receiving Antenna
11. Frequency Receiver
12. Microprocessor
13. High Voltage Generator
14. Voltage Storage Means
15. Electronic Switch
16. Level Switcher
17. Lid Safety
18. Ejection Conduit

19. Magazine Guide
20. Identification Tag
21. Electronic Connection Port
22 Igniter
23. Projectile Holder
24. Projectile Safety
25. Electronic Ignition Safety
26. Spring Holder
27. Ejection Spring
28. Magazine Notch
29. Magazine Lid
30. Weapon Body
31. Audible Warning Unit
32. Transmitting Antenna
33. Frequency Transmitter
34. Display Panel
35. Main Control Unit
36. Operation Mode Switcher
37. Shooting Mode Switcher
38. High Voltage Source
39. Tag Reader
40. Power Unit
41. Main Battery
42. Charging Connector
43. Charging Unit
44. Identification Antenna
45. Trigger
46. Apparatus Module
47. Negative End
48. Positive End
49. Projectile Selection Button
50. Projectile Detector
51. Electroshock Projectiles
52. Electroshock Device

DETAILED DESCRIPTION

The present invention relates to a novel electroshock device (52) which can operate both in contact also contactless, which has no wired connection, and by which shock volume and duration to be applied to target living can be adjusted as desired by the user.

The subject matter electroshock device (52) consists of three basic components as can be seen in FIGS. 1, 3 and 4. Said components are weapon body (30), magazine (6) and electroshock projectiles (51). Electroshock projectiles (51) are used by being positioned inside the magazine (6). And the magazine (6) is positioned into the weapon body (30). The subject matter electroshock device (52) is constituted by the combination of these three components.

The subject matter electroshock device (52) can be both used in contact manner and in also contactless manner owing to structure it has. The factor enabling in contact usage is the structure of the weapon body (30). And the contactless usage is ensured by electroshock projectiles (51) ejected towards the target. After said electroshock projectiles are ejected, they do not have any physical connection with the weapon body (30) and the magazine (6).

The structure of electroshock projectiles (51) can be seen in FIG. 1. Body portion of said electroshock projectiles (51) is formed by combination of an upper body (1) and a lower body (2) parts. At the rear end of the electroshock projectile (51), there is a wing (3) structure positioned at the connection point of the lower body (2) and the upper body (1). Said wing (3) structure assists the ejected electroshock projectile (51) to travel in a straight direction in the air. There is one positive needle (4) and one negative needle (5) at the front end of the electroshock projectile (51). The main function of the positive needle (4) and the negative needle (5) is to ensure that electroshock can be applied to the target living. To realize that, both the positive needle (4) and negative needle (5) must be contacted with the target. Since the positive needle (4) and the negative needle (5) are positioned at the front end of the electroshock projectiles (51), said needles come into contact with target when the electroshock projectiles (51) are ejected towards the target. Thereby, desired shock can be applied to target living. Owing to the fact that the positive needle (4) and the negative needle (5) are manufactured of sterile materials, there is no risk of infection for the target living.

The electroshock projectiles (51) located inside the subject matter electroshock device (52) has a special electronic internal structure in order to apply desired electricity shock on target living. There are various units inside said electronic internal structure and all the controls regarding the shock to be applied on target are managed through these units.

The units inside the electronic internal structure of the electroshock projectiles (51) can be seen in FIG. 2. Said electronic internal structure has one battery (7). The battery (7) stores the energy needed for the electroshock projectile (51) to shock target living. It has a rechargeable structure. Thus, the battery (7) structure energy of which is reduced or finished after use of electroshock projectile (51) is recharged and the electroshock projectile (51) can be reused. The battery (7) structure is connected to one power unit (8). The power unit (8) generates the voltage levels required for units in the electronic internal structure by the energy it receives from the battery (7) and supplies these units. Thereby, said units can obtain the energy they need to perform the functions they have.

The micro switch (9) structure is the leading unit in the electronic internal structures of the electroshock projectiles (51). The micro switch (9) ensures that the electroshock projectile (51) is electronically in inactive state when it is in the magazine (6) structure. By this measure, the electroshock projectiles (51) cannot be activated until they ejected out of the magazine (6). After the ejected electroshock projectiles (51) leave the magazine (6), they are activated by the micro switch (9) and are made ready to shock the target living.

The micro switch (9) unit in the electronic internal structures of the electroshock projectiles (51) is in connection with the microprocessor (12). The microprocessor (12) is a control unit which ensures that the units within the electronic internal structure perform their duties. There is one high voltage generator (13) connected to the microprocessor (12). The high voltage needed for the shock to be applied by the electroshock projectile (51) to the target living is obtained by the fact that the high voltage generator (13) generates through the battery voltage. The high voltage generator (13) is controlled by the microprocessor (12). The high voltage generated by the high voltage generator (13) is stored in the voltage storage means (14).

The voltage storage means (14) is connected to negative needle (5) from one side and to electronic switch (15) unit from other side. When the electroshock projectile (51) is activated by being ejected towards the target, the voltage storage device (14) directly transmits the predetermined voltage to the negative needle (5). The voltage level to be transmitted to the positive needle (4) is transmitted through the electronic switch (15) unit located between the voltage storage means (14) and the positive needle (4). Thus, the voltage to be transmitted to the positive needle (4) is transferred under control of electronic switch (15). And the electronic switch (15) is controlled by the microprocessor (12). In cases where the electroshock projectile (51) should be activated by reaching the target, the microprocessor (12) allows the positive needle (4) to be loaded with voltage by signaling command to the electronic switch (15). In accordance with the command from the microprocessor (12), the electronic switch (15) ensures that the high voltage in the voltage storage means (14) is transmitted to the positive needle (4) and that the high voltage stored in the electroshock projectile (51) is applied to the target in a controlled manner.

The electronic internal structure of the electroshock projectile (51) has a level switch (16). Said level switch (16) is directly connected to the microprocessor (12). The level switch (16) is the unit that determines that how much and how long the electroshock projectile (51) applies shock to the target. According to the preference of the users, the level switch (16) transmits the respective values to the microprocessor (12) and ensures that the electroshock projectile (51) operates according to said values. Further, there is a receiving antenna (10) structure within the electronic internal structure. Said receiving antenna (10) has a structure detecting the command signals that the weapon body (30) sends to the electroshock projectile (51) after the electroshock projectile (51) is ejected. The receiving antenna (10) has a structure capable of detecting commands transmitted by radio frequencies. It transmits the commands that are detected to a frequency receiver (11) connected to itself. The frequency receiver (11) transmits the commands sent in the form of radio signals to the microprocessor (12) by making them detectable by the microprocessor (12). By this means, it is possible to control the electroshock projectiles (51) wirelessly even after ejection.

The electroshock projectiles (51) within the subject matter electroshock device (52) are used by being positioned inside the magazine (6) structure. The structure of said magazine (6) can be seen in FIG. 3. The electroshock projectiles (51) are positioned within the ejection conduits (18) within the magazine (6). The number of the electroshock projectiles (51) correspond to the number of ejection conduit (18) in the magazine (6) structure. The maximum number electroshock projectile (51) loaded at one time varies according to the structure of the magazine (6) of the electroshock device (52). The number of ejection conduits (18) of the magazine (6) may preferably be at desired number being at least one. Accordingly, electroshock projectiles (51) as many as existing ejection conduits (18) can be ejected rapidly by electroshock device (52). An exemplary electroshock device (52) having three ejection conduits (18) can be seen in FIG. 4.

There is a magazine guide (19) structure on outer lower part of bottom portion of the magazine (6). The magazine guide (19) is the structure that allows the magazine (6) to fit into the weapon body (30). There is a magazine notch (28) on outer part of upper portion of the magazine (6). The magazine notch (28) ensures that the magazine (6) is secured after being positioned inside the weapon body (30). There is one identification tag (20) positioned at any location on the magazine (6). The identification tag (20) is an identifying unit that allows the weapon body (30) to recognize the magazine (6) structure and to determine the identities of the electroshock projectiles (51) inside the magazine (6). Also, there is an electronic connection port (21) positioned at any location on the magazine (6). The electronic connection port (21) is responsible for providing the electronic connection between the magazine (6) and the weapon body (30).

There is a spring holder (26) positioned to be at the closed end and behind the electroshock projectile (51) inside of each ejection conduit (18) located in the magazine (6). The spring holder (26) is responsible for securing ejection spring (27) positioned right on it. And the ejection spring (27) positioned on the spring holder (26) is responsible for sending the electroshock projectile (51) located right in front of it with high speed towards the target when the firing process is activated. The structure which ensures that the electroshock projectile (51) is fixedly retained ready for firing is the projectile holder (23). The projectile holder (23) is a structure located in an individual manner in each ejection conduit (18), connected right onto center point of closed end of ejection conduit (18) and connected to the electroshock projectile (51) from the center of its rear end by passing through the spring holder (26) and the ejection spring (27). When the electroshock projectile (51) is to be fired, the projectile holder (23) separate thus allowing the shooting of the electroshock projectile (51).

At the end portion of the projectile holder (23) connected to ejection conduit (18), there are igniters (22) positioned such that they are respectively in each projectile holder (23). The igniters (22) positioned in closed ends of each ejection conduit (18) such that they are behind the spring holder (26) as well are the main components ensuring the firing of electroshock projectiles (51). The igniters (22) electronically activate the electroshock projectile (51). The igniters (22) activated by the firing command ensure that the projectile holder (23) on which the igniters are located is separated by dissipating high heat. As soon as the projectile holder (23) is separated, the electroshock projectile (51) is released and is ejected from the ejection conduit (18) by the pushing force of the ejection spring (27) behind it. Furthermore, there is an electronic ignition safety (25) positioned at any location on the magazine (6). The electronic ignition safety (25) prevents the ejection of the electroshock projectile (51) by blocking the activation of the igniter (22) in cases when the magazine (6) is not inserted into the weapon body (30). By this means, an electronic protection is ensured.

Inside the magazine (6), in each ejection conduit (18), there are projectile safety (24) structures positioned right in front of electroshock projectile (51) secured into the magazine (6). The projectile safety (24) ensures that the electroshock projectile (51) remains fixed in the ejection conduit (18) in cases when the magazine (6) is not inserted into the weapon body (30). Moreover, there is a magazine lid (29) at the open end of each ejection conduit (18) within the magazine structure (6). Said magazine lids (29) can be opened manually by the users and also can be opened as a result of the rapid impact of the electroshock projectiles (51) fired when in closed position. Therefore, it is possible to perform shooting with the subject matter electroshock device (52) even if the magazine lids (29) are in closed position. Right in front of the magazine lids (29), there is a lid safety (17) which is positioned so as to be inside of the ejection conduits (18). In cases when the magazine (6) structure is not inserted into the weapon body (30), the lid safety (17) avoids the ejection of electroshock projectile (51) out of the magazine (6) by preventing the magazine lid (29) from opening if the projectile safety (24) is released.

There is a main control unit (35) located at any point within the weapon body (30), which constitutes the largest part of the subject matter electroshock device (52). The main control unit (35) is the control unit which manages the entire control of the electroshock device (52). Furthermore, it also ensures the communication control between the units. The main control unit (35) is capable of applying electricity to the target after the shot by remotely controlling the electroshock projectiles (51) ejected towards the target. There are one transmitting antenna (32) structure and frequency transmitter (33) structures positioned on any point on the weapon body (30). Said structures are those which help the main control unit (35) to control the ejected electroshock projectiles. The main control unit (35) transmits commands that are to be sent to the ejected electroshock projectiles (51) to the frequency transmitter (33). The frequency transmitter (33) transmits the commands coming from the main control unit (35) to the transmitting antenna (32) by transforming them to radio frequencies. The commands made to be transmittable for the transmitting antenna (32) are signaled to receiver antenna (10) within the electroshock projectile (51) by the transmitting antenna (32). Thereby, the main control unit (35) is able to send commands to ejected electroshock projectiles, and the target living can be subjected to additional shock effect in case of need.

The subject matter electroshock device (52) has a structure that is capable of also applying contacted shock to target livings. In this context, the weapon body (30) has one positive end (48) and one negative end (47) structures. The positive end (48) and the negative end (47) structures are positioned on any two points on the edge portion of the space in which the magazine 6 is positioned in the weapon body (30) in a manner that they do not to contact each other. The outwardly facing end portions of the positive end (48) and the negative end (47) structures are slightly protruding with respect to the weapon body (30). When a targeted living is desired to be subjected to contacted electroshock by the subject matter electroshock device (52), desired shocking process can be performed when the electroshock device (52) is contacted with the target such that both positive end (48) and the negative end (47) contact with the target at the same time. Therefore said electroshock device (52) can be preferably used in contacted manner.

There is one main battery (41) structure positioned on any point within the weapon body (30). The main battery (41) is responsible for storing energy to meet the energy requirement of all the units within the weapon body (30). There is one power unit (40) connected to the structure of the main battery (41) and positioned on any point on the weapon body. The power unit (40) converts the energy it receives from the main battery (41) to proper voltage levels so that the units within the electroshock device (52) can use them. Thereby, the voltage levels needed by the units within the weapon body (30) are provided. When the electroshock device (52) is desired to be used in contacted manner, the shock voltage that the positive end (48) and the negative end (47) transmit to the target living is supplied by the high voltage source (38) positioned at any point within the weapon body (30). The high voltage source (38) controlled by the main control unit (35) generates the high voltage to be used by the electroshock device (52) that operates in contacted shocking mode, and generates shock voltage applied to the target as long as the user continues pulling the trigger (45) when in contacted shock mode.

There is a display panel (34) at any location within the weapon body (30). The display panel (34) is a module showing detailed information about the electroshock device (52), such as the number of present electroshock projectile (51) in the magazine (6), and the present battery level of the electroshock device (52). By this means, the users can instantly check the details about the current state of the electroshock device (52) whenever desired. Also, there is an audible warning unit (31) located at any point within the weapon body (30). The users are audibly informed about the status of the electroshock device (52) via said audible warning unit (31). Information such as whether the electroshock device (52) is ready for firing or in the safety position, burst firing status, the number of electroshock projectiles (51) in the magazine (6), and the charging status of the electroshock device (52) can be instantly showed to the user.

There is an operation mode switcher (36) and a shooting mode switcher (37) positioned at any point on the weapon body (30). Said operating mode switcher (36) functions to adjust the current state of the electroshock device (52). With the operating mode switcher (36), the electroshock device (52) can be switched between three different modes. The first of those modes is "safety" mode. In the safety mode, the electroshock device (52) is prevented from firing. So that, the electroshock device (52) is kept in safety mode when not in use. The second mode of the operating mode switcher (36) is the "semi-automatic firing" mode. In the semi-automatic mode, the electroshock projectiles (51) within the electroshock device (52) are fired one by one to the target respectively. The third mode of the operating mode switcher (36) is the "burst firing" mode. In the burst firing mode, the electroshock projectiles (51) within the electroshock device (52) are fired consecutively in serial manner. Therefore, when all the electroshock projectiles (51) are desired to be fired rapidly, then the burst firing mode is used.

The shooting mode switcher (37) in the electroshock device (52) is a unit used when the "burst firing" mode is selected in the operation mode switcher (36). The shooting mode switcher (37) ensures that the way of burst firing mode to be performed is adjusted. The burst firings to be performed with the shooting mode switcher (37) can be done in two different ways. The first mode of the shooting mode switcher (37) is the "classic burst" mode. When firing in classic burst mode, the electroshock projectiles (51) within the electroshock device (52) are rapidly consecutively fired in classic manner as long as the user pulls the trigger (45). The electroshock projectiles (51) in the electroshock device (52) remain in the magazine (6) as soon as the user removes his/her finger from the trigger (45) and are not fired. The "explosion" mode, which is the second mode of the shooting mode switcher (37) operates differently. When firing in explosion mode, all the electroshock projectiles (51) within the electroshock device (52) are consecutively fired to the target living when the user pulls the trigger (45) once. Thus, there is no need to pull the trigger (45) for a some time in order to fire electroshock projectiles (51), and all the electroshock projectiles (51) are successively fired with only one pulling movement.

The weapon body (30) has an identification antenna (44). The identification antenna (44) receives information about the magazine (6) by reading the identification tag (20) included in the magazine (6) structure. It transmits the information it received to the tag reader (39) again which is located at any point within the weapon body (30). The tag reader (39) identifies the electroshock projectiles (51) contained in the magazine (6) by detecting the data from the identification antenna (44). Thus, the weapon body (30) can identify the types of electroshock projectiles (51) included in the magazine (6). By this means, the information of the existing electroshock projectiles (51) can be displayed on the display panel (34).

There is a charging connector (42) positioned at any point within said weapon body (30). The subject matter electroshock device (52) can be charged via the charging connector (42). Any charging adapter structure capable of charging said electroshock device (52) is connected to the electroshock device (52) through the charging connector (42). The charging adapter connected to the charging connector (42) charges the battery (41) structure through the charging unit (43) positioned at any point within the weapon body (30). The charging unit (43) is the unit performing the charging process of the battery (41).

There is a projectile selection button (49) located at any point on the weapon body (30) of the subject matter electroshock device (52). By means of the projectile selection button (49), it is possible to make selection between the electroshock projectiles (51) fired to the target. Thereby, it is possible to apply additional shock to target living on which the electroshock projectile (51) chosen is located. The existence of the electroshock projectiles (51) present within the magazine (6) can be detected instantly by means of a projectile detector (50) located at any point on the weapon body (30). The projectile detector (50) detects the information which of the electroshock projectiles (51) within the magazine (6) are ejected and which are not ejected and transmits these data to the main control unit (35). By this means, the main control unit (35) can be instantly informed about the status of the electroshock projectiles (51) contained in the magazine (6).

There is an apparatus module (46) integral with the weapon body (30), at lower side of end portion of the weapon body (30) wherein it has the magazine (6) cavity. The apparatus module (46) in question can be seen in FIG. 4. The main duty of the apparatus module (46) is to form a portion on which accessory components such as laser, camera, and flashlight can be attached. Said accessory components which may be needed during the use of the electroshock device (52) are positioned into the apparatus module (46). Said accessory components may preferably be used individually by being positioned on the apparatus module (46) and also they may be used by being positioned on the apparatus module (46) to be together with different combinations.

The subject matter electroshock device (52) can be used both in contacted manner and also remotely depending completely on the preferences of the users. Hence, applying different ways of use in different cases is possible. By means of the fact that the electroshock projectiles (51) used with the electroshock device (52) are wireless, there is no possibility to encounter any problem due to wires during use.

By means of the structure of said electroshock device (52), the electroshock projectiles (51) can be controlled wirelessly even after being fired to the target. By means of internal structures of the electroshock projectiles, it possible that (51) the electroshock projectiles (51) fired to the target can apply additional shocks to the target. The duration and volume of said additional shocks can completely vary depending on the user preferences, and can be readily adjusted from the weapon body (30). The status of the electroshock projectiles (51) can be constantly controlled by said electroshock device (52).

The invention claimed is:

1. Novel electroshock device comprising at least one electroshock projectile which is used by being positioned into a magazine ensures that a target is subjected to shock by being fired to the target, and which has no physical connection with the magazine or with a weapon body after being fired to the target; body part of which consists of a combination of an upper body and a lower body part, and which has a wing structure on its rear end that helps for traveling in a straight line in the air, and which has a positive needle and a negative needle positioned so as to contact with the target on its front end, and which has an electronic internal structure comprising; a battery storing energy required for the electroshock projectile to shock the target living in order to apply desired electrical shock to the target living and being in a rechargeable structure; a power unit generating voltage levels needed for units in the electronic internal structure by the energy it receives from the battery and supplying those units; a micro switch structure ensuring that the electroshock projectile is electronically in inactive state when it is in the magazine structure; a microprocessor being a control unit which ensures that the units within the electronic internal structure perform their duties; a high voltage generator generating the high voltage needed for the shock to be applied by the electroshock projectile to the target living through the battery voltage and being controlled by the microprocessor; a voltage storage means storing the high voltage generated by the high voltage generator, being connected to negative needle from one side and to an electronic switch unit from other side, and controlling the voltage to be transmitted to the negative needle; an electronic switch located between the voltage storage means and the positive needle and controlling the voltage to be transmitted to the positive needle; a receiver antenna having a structure capable of detecting commands transmitted by radio frequencies and detecting the command signals that the weapon body sends to the electroshock projectile after the electroshock projectile is fired; a frequency receiver transmitting commands received in the form of radio signals detected by the receiver antenna to the microprocessor by making them detectable by the microprocessor and thus, ensuring that the electroshock projectiles can be wirelessly controlled even after being fired; and a level switch directly connected to the microprocessor, transmitting the respective values to the microprocessor and ensuring that the electroshock projectile operates according to said values, determining that how much and how long the electroshock projectile would apply shock to the target;

a magazine used by being positioned inside the weapon body, being responsible for housing the electroshock projectiles to be fired to the target, having at least one ejection conduit in each of which an electroshock projectile is placed, having an ejection spring responsible for launching the electroshock projectiles inside of each ejection conduit towards the target and having an identification tag ensuring that the weapon body recognize the magazine structure and identify the electroshock projectiles contained in the magazine by being positioned on any point;

a weapon body comprising a main control unit responsible for housing the magazine structure containing the electroshock projectiles in it, having a structure in which the magazine structure can be fitted, both managing all the controls of the electroshock device by being positioned on any point and making it possible to apply electroshock on the target also after the firing by remotely controlling fired electroshock projectiles, a positive end and a negative end structures positioned on any two point on the edge part of the cavity in which the magazine is positioned on the weapon body so as not to contact each other, and which can operate both in contacted manner and also contactless, which has no wired connection, and by which shock volume and duration to be applied to target living can be adjusted as desired by the user.

2. The electroshock device according to claim 1, characterized in that; it comprises a projectile holder positioned in each ejection conduit of the magazine it has, connected to center of closed end of the ejection conduit and engaged from the wing of the electroshock projectile by passing through spring holder and ejection spring and ensuring that the electroshock projectile is held ready for being fired.

3. The electroshock device according to claim 1, characterized in that; it comprises igniters included by each projectile holder of the magazine it has and being positioned to be at the rear part of the spring holder, ensuring that the projectile holder on which it is located is separated by means of dissipating high heat when activated and that the electroshock projectiles are fired.

4. The electroshock device according to claim 1, characterized in that; it comprises a spring holder positioned to be at the closed end inside of each ejection conduit and behind the electroshock projectile of the magazine it has, being responsible for securing the ejection spring.

5. The electroshock device according to claim 1, characterized in that; it comprises an electronic connection port positioned on any point of the magazine it has and ensuring the electronic connection between the magazine and the weapon body.

6. The electroshock device according to claim 1, characterized in that; it comprises an electronic ignition safety positioned on any point of the magazine it has and preventing the ejection of the electroshock projectile by blocking the activation of the igniter in cases when the magazine is not inserted into the weapon body.

7. The electroshock device according to claim 1, characterized in that; it comprises a magazine notch positioned on the outer surface of the upper portion of the magazine it has and ensuring that the magazine is secured after being positioned inside the weapon body.

8. The electroshock device according to claim 1, characterized in that; it comprises a magazine guide positioned on the outer lower part of the bottom portion of the magazine has and ensuring that the magazine is fitted into the weapon body.

9. The electroshock device according to claim 1, characterized in that; it comprises magazine lids positioned to be one in open end portion of each ejection conduit of the magazine has, and opened manually by the users and also being opened as a result of the rapid impact of the electroshock projectiles fired when in closed position, thus allowing the electroshock device to perform shooting.

10. The electroshock device according to claim 1, characterized in that; it comprises a projectile safety contained in each ejection conduit, positioned right in front of the electroshock projectile secured into the magazine has, and ensuring that the electroshock projectile remains fixed in the ejection conduit in cases when the magazine is not inserted into the weapon body.

11. The electroshock device according to claim 1, characterized in that; it comprises a lid safety positioned inner portion of the ejection conduits so as to be right in front of the magazine lids of the magazine has, and avoiding the ejection of electroshock projectile out of the magazine by preventing the magazine lid from opening if the projectile safety is released in cases when the magazine structure is not inserted into the weapon body.

12. The electroshock device according to claim 1, characterized in that; it comprises an audible warning unit positioned at any point on the weapon body it has, and providing voice information to the users about the status of the electroshock device.

13. The electroshock device according to claim 1, characterized in that; it comprises a display panel positioned at any point on the weapon body it has, and showing information about the electroshock device, such as the number of present electroshock projectile in the magazine, and the present battery level of the electroshock device.

14. The electroshock device according to claim 1, characterized in that; it comprises a frequency transmitter positioned at any point on the weapon body it has, and transmitting the commands coming from the main control unit to the transmitting antenna by transforming them to radio frequencies in order to send to ejected electroshock projectiles.

15. The electroshock device according to claim 1, characterized in that; it comprises a transmitting antenna positioned at any point on the weapon body it has, and transmitting the radio frequency commands from the frequency transmitter to the receiver antenna inside the electroshock projection.

16. The electroshock device according to claim 1, characterized in that; it comprises an operating mode switch positioned at any point on the weapon body it has, enabling the electroshock device to be able to adjust its current state, allowing it to operate in either "safety" mode, "semi-automatic" mode or "burst fire" mode.

17. The electroshock device according to claim 1, characterized in that; it comprises a shooting mode switcher positioned at any point on the weapon body it has and allowing the burst firing to be performed either in "classic burst" mode or in "explosion" mode in cases when the "burst fire" mode on the operating mode switcher is chosen.

18. The electroshock device according to claim 1, characterized in that; it comprises a main battery positioned at any point on the weapon body it has, being responsible for storing energy to meet the energy requirement of all the units requiring energy within the weapon body.

19. The electroshock device according to claim 1, characterized in that; it comprises a power unit positioned at any point on the weapon body it has, connected to the main battery, and being responsible for transforming the energy it receives from the main battery into suitable voltage levels in order that the units contained in the electroshock device can utilize.

20. The electroshock device according to claim 1, characterized in that; it comprises a high voltage source positioned at any point on the weapon body it has, controlled by the main control unit, generating the shock voltage applied to the target as long as the user pulls the trigger for the electroshock device operating in contacted shock mode.

21. The electroshock device according to claim 1, characterized in that; it comprises a charging unit positioned at any point on the weapon body has, and enabling the electroshock device to be charged via the charging connector of the electroshock device.

22. The electroshock device according to claim 1, characterized in that; it comprises an identification antenna positioned at any point on the weapon body it has, reading the identification tag of the magazine and receiving information about the magazine and transmitting the these information to a tag reader on the weapon body.

23. The electroshock device according to claim 1, characterized in that; it comprises a tag reader positioned at any point on the weapon body it has, and ensuring the identification of the electroshock projectiles in the magazine by detecting the data coming from the identification antenna.

24. The electroshock device according to claim 1, characterized in that; it comprises a projectile detector positioned at any point on the weapon body it has, and instantly determining the presence of electroshock projectiles in the magazine and transmitting to the main control unit the information of which electroshock projectiles in the magazine are ejected out and which are not.

25. The electroshock device according to claim 1, characterized in that; it comprises a projectile selection button positioned at any point on the weapon body it has, allowing to make selection between fired electroshock projectiles in order to apply additional shock to the target living on which it is contacted.

26. The electroshock device according to claim 1, characterized in that; it comprises an apparatus module positioned at any point on the weapon body it has, forming a portion integral with the weapon body; wherein accessory components such as laser, camera, flashlight can be attached.

* * * * *